US008241043B1

(12) United States Patent
Lin

(10) Patent No.: US 8,241,043 B1
(45) Date of Patent: Aug. 14, 2012

(54) PROBE CONNECTOR

(75) Inventor: Jui-Pin Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 13 days.

(21) Appl. No.: 13/078,207

(22) Filed: Apr. 1, 2011

(51) Int. Cl.
*H01R 11/30* (2006.01)

(52) U.S. Cl. ..... 439/39

(58) Field of Classification Search ..... 439/39
See application file for complete search history.

(56) References Cited

U.S. PATENT DOCUMENTS 7,097,461 B2 * 8/2006 Neidlein ..... 439/66
7,311,526 B2 * 12/2007 Rohrbach et al. ..... 439/39
7,364,433 B2 * 4/2008 Neidlein ..... 439/66
7,497,693 B1 * 3/2009 Wu ..... 439/39
7,566,224 B2 * 7/2009 Wu ..... 439/39
2007/0072443 A1 * 3/2007 Rohrbach et al. ..... 439/39
2007/0161262 A1 * 7/2007 Lloyd ..... 439/39
2010/0144164 A1 * 6/2010 Wang et al. ..... 439/39

* cited by examiner

*Primary Examiner* — Gary F. Paumen
(74) *Attorney, Agent, or Firm* — WPAT, P.C.; Anthony King

(57) ABSTRACT

A probe connector adapted for electrically interconnecting with a mated connector which has two portions thereof provided with different magnetism selected from a south magnetic pole and a north magnetic pole respectively, includes an insulating housing, a plurality of probe pins and a foolproof mechanism. The insulating housing defines a plurality of inserting holes penetrating therethrough for receiving the probe pins. The foolproof mechanism is made of magnetic material and includes an upper cover and a lower cover which have different magnetism selected from a north magnetic pole and a south magnetic pole respectively. The upper cover and the lower cover are mounted to two opposite sides of the insulating housing. The probe connector can be interconnected with the mated connector based on principles of homopolar repulsion and heteropolar attraction between the upper cover and the lower cover and the two portions of the mated connector.

5 Claims, 3 Drawing Sheets

PROBE CONNECTOR

BACKGROUND OF THE INVENTION

1. Field of the Invention

The present invention relates to a probe connector, and more particularly to a probe connector capable of being effectively interconnected with a mated connector.

2. The Related Art

A traditional probe connector generally includes an insulating housing and a plurality of probe pins. The insulating housing has a front surface. The front surface defines a plurality of inserting holes spaced at regular intervals, and each of the inserting holes penetrates through the insulating housing along a front-to-rear direction. The probe pins are inserted in the inserting holes respectively. However, when the probe connector is engaged with a mated connector, it's apt to cause a wrong connection between the probe connector and the mated connector because of no identification mechanism for a correct mated position.

SUMMARY OF THE INVENTION

An object of the present invention is to provide a probe connector adapted for electrically interconnecting with a mated connector which has two portions thereof provided with different magnetism selected from a south magnetic pole and a north magnetic pole respectively. The probe connector includes an insulating housing, a plurality of probe pins and a foolproof mechanism. The insulating housing has a base body. A front surface of the base body protrudes frontward to form a tongue portion. The insulating housing defines a plurality of inserting holes penetrating through the base body and the tongue portion along a front-to-rear direction. The probe pins are inserted forward in the corresponding inserting holes of the insulating housing. Each of the probe pins has a touching portion capable of projecting forward out of the corresponding inserting hole. The foolproof mechanism is made of magnetic material and includes an upper cover and a lower cover which have different magnetism selected from a north magnetic pole and a south magnetic pole respectively. The upper cover and the lower cover are mounted to two opposite sides of the tongue portion and further end-to-end attracted with each other to be integrated together and enclose the tongue portion therebetween. The probe connector can be interconnected with the mated connector based on principles of homopolar repulsion and heteropolar attraction between the upper cover and the lower cover of the foolproof mechanism and the two portions of the mated connector.

As described above, in use, the upper cover and the lower cover of the foolproof mechanism having different magnetism can effectively guide the probe connector to be mated with the mated connector based on the principle of homopolar repulsion and heteropolar attraction, because of corresponding two portions of the mated connector being provided with different magnetism. So, it can avoid the wrong connection between the probe connector and the mated connector, and a better electrical connection is assured.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
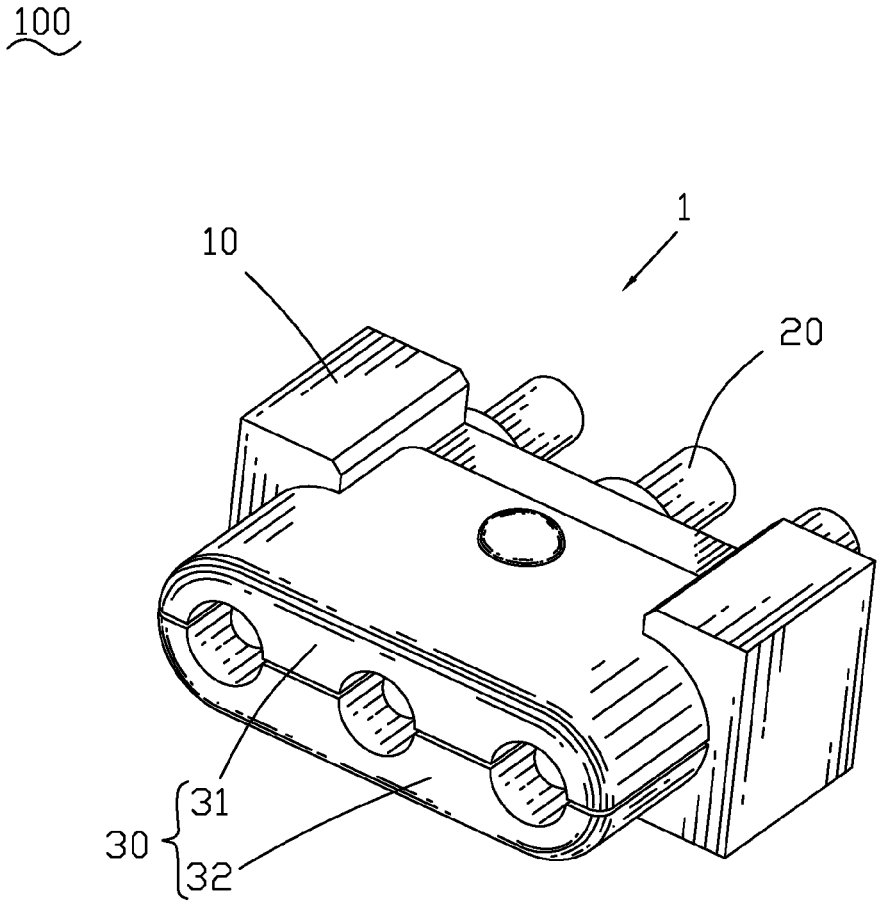
FIG. 1 is a perspective view of a probe connector according to the present invention.

With reference to FIG. 1, a probe connector 100 according to the present invention includes an insulating housing 10, a plurality of probe pins 20 and a foolproof mechanism 30 mounted to the insulating housing 10 respectively.

Figure 2:
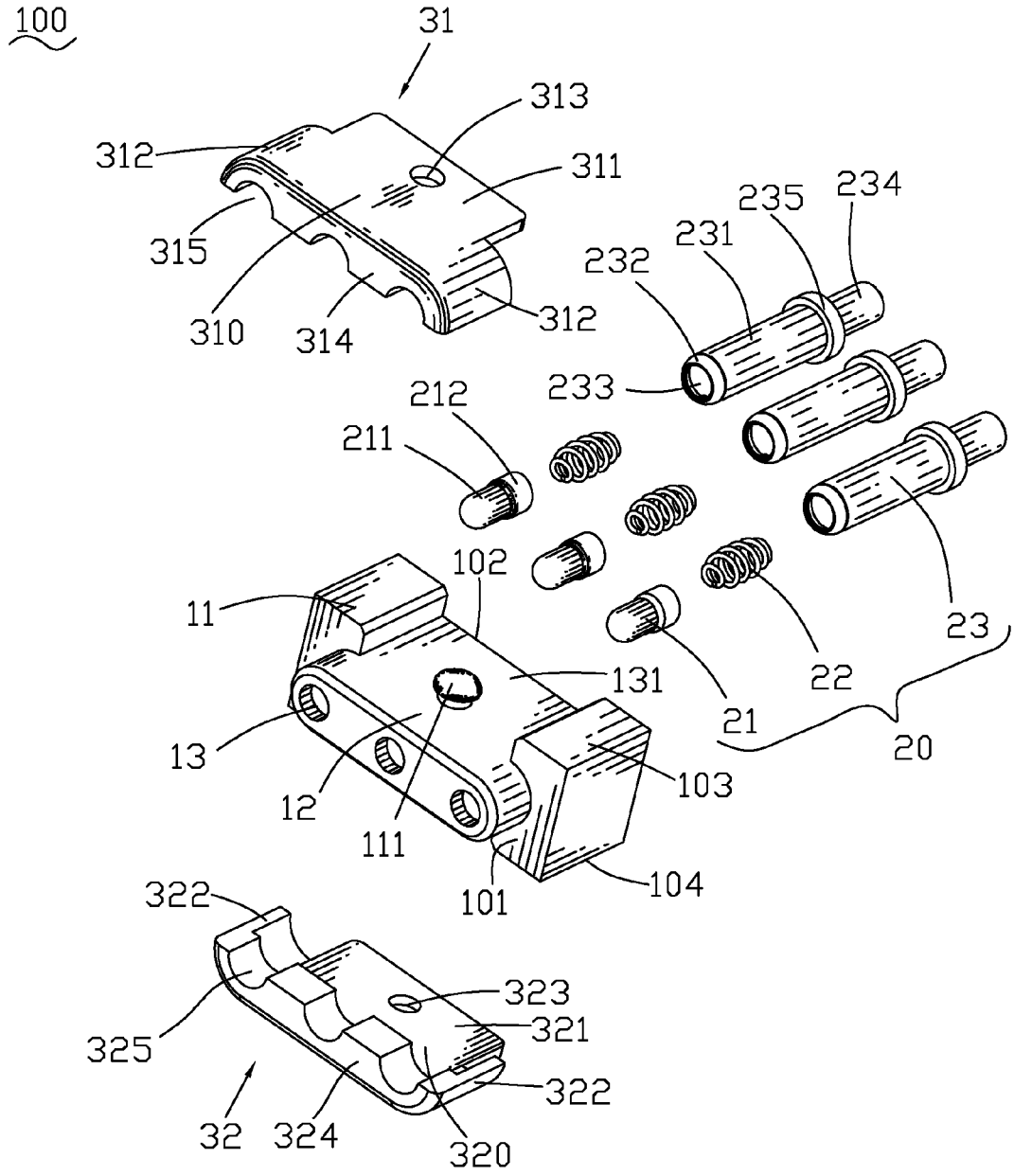
FIG. 2 is an exploded perspective view of the probe connector of FIG. 1.
Figure 3:
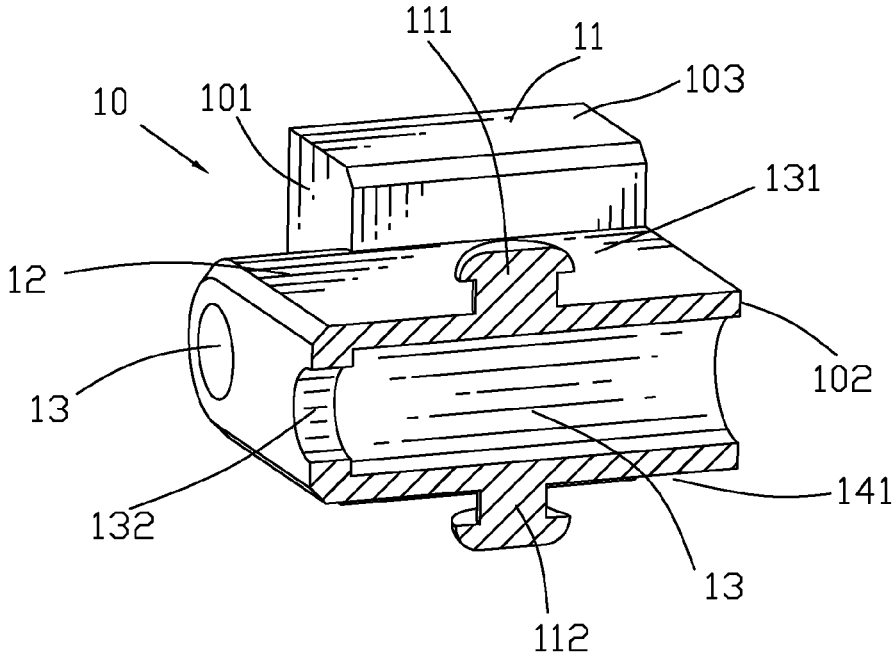
FIG. 3 is a cross-sectional view of an insulating housing of the probe connector of FIG. 2.
Figure 4:
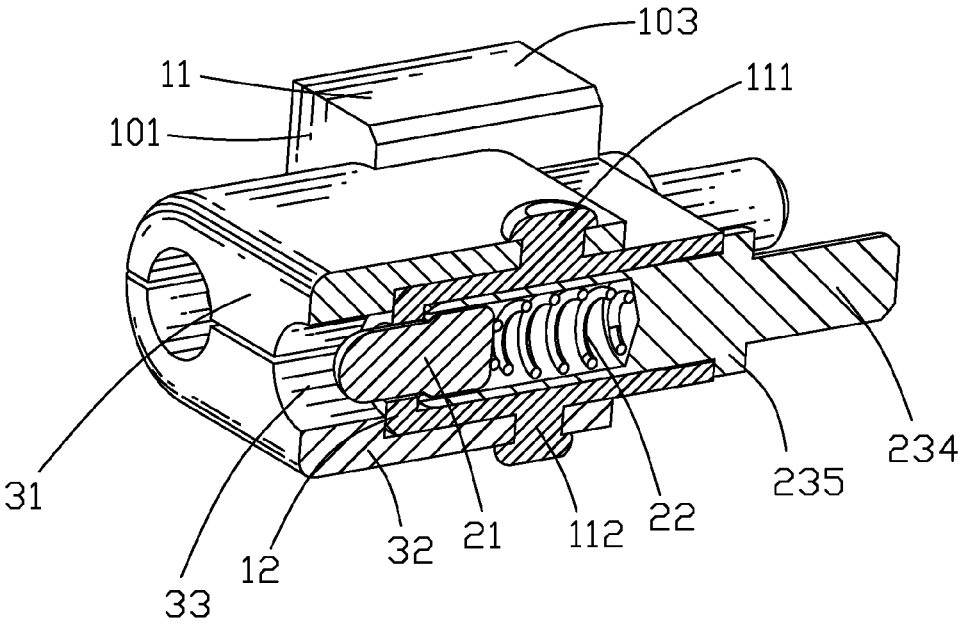
FIG. 4 is a cross-sectional view of the probe connector of FIG. 1.

Referring to FIGS. 2-3, the insulating housing 10 has a base body 11 of rectangular shape. The base body 11 has a front surface 101, a rear surface 102, a top surface 103 and a bottom surface 104. A middle of the front surface 101 of the base body 11 protrudes frontward to form a tongue portion 12 of an elliptic shape seen from a front view. The insulating housing 10 defines a plurality of inserting holes 13 longitudinally penetrating through the base body 11 and the tongue portion 12. Middles of the top surface 103 and the bottom surface 104 are cut off to define a first opening 131 and a second opening 141 passing through the front surface 101 and the rear surface 102 of the base body 11. A first fastening portion 111 and a second fastening portion 112 are oppositely protruded in substantial middles of the first opening 131 and the second opening 141, respectively. A front portion of an inner sidewall of the inserting hole 13 protrudes inward to form a ring-shaped blocking wall 132.

Referring to FIG. 2, each of the probe pins 20 includes a plunger 21, an elastic element 22 and a shell 23. The plunger 21 has a cylindrical base portion 212 and a touching portion 211 protruding forward from a middle of a front of the base portion 212. The shell 23 is made of metal material, and includes a hollow barrel 231 looped from a metal plate and having a front end opened freely. A periphery of the front end of the barrel 231 is shrunk inward to form a ring-shaped blocking eaves 232 with a fastening hole 233 being formed in a middle thereof. A periphery outside of a rear end of the barrel 231 protrudes outward to form a ring-shaped blocking portion 235. A rear side of the barrel 231 extends rearward to form a soldering portion 234.

Referring to FIGS. 1-3, the foolproof mechanism 30 is made of magnetic material, and includes an upper cover 31 and a lower cover 32 which have different magnetism selected from a north magnetic pole and a south magnetic pole, respectively. The upper cover 31 has a first base board 310 of rectangular shape of which two opposite ends are bent downward to form two arc-shaped upper sheltering walls 312. A rear edge of the first base board 310 extends rearward to form a first fastening board 311 with a first hole 313 opened in a substantial middle thereof. A front edge of the first base board 310 extends downward to form a first front wall 314 further connected with two front edges of the upper sheltering walls 312. Several portions of a bottom of the first front wall 314 are concaved upward to form a plurality of hemicycle first grooves 315 longitudinally penetrating through the first front wall 314. The lower cover 32 has a similar shape as that of the upper cover 31, and has a second base board 320, a second fastening board 321, two arc-shaped lower sheltering walls 322, a second hole 323, a second front wall 324, and a plurality of hemicycle second grooves 325 longitudinally penetrating through the second front wall 324. The difference between the shapes of the upper cover 31 and the lower cover 32 is that the first hole 313 is different from the second hole 323 in diameter.

Referring to FIGS. 1-4, when assembling the probe connector 100, the elastic element 22 is disposed in the barrel 231 of the shell 23 along a front-to-rear direction with a rear end thereof resisting against an inner sidewall of the barrel 231. The plunger 21 is movably inserted in the barrel 231 along the front-to-rear direction by means of the base portion 212 being movably restrained in the barrel 231 with a periphery of a front end thereof resisting against the blocking eaves 232 and a rear end thereof resisting against a front end of the elastic element 22. The touching portion 211 of the plunger 21 projects forward out of the fastening hole 233 of the barrel 231 to connect with a mated connector (not shown). The probe pin 20 is inserted forward in the inserting hole 13 of the insulating housing 10 with the blocking eaves 232 of the shell 23 resisting against a rear of the blocking wall 132 and a front of the blocking portion 235 abutting against the rear surface 102 of the base body 11. The soldering portion 234 projects behind the rear surface 102 of the base body 11. The foolproof mechanism 30 are mounted to the insulating housing 10, with the first fastening board 311 and the second fastening board 321 inserted rearward in the first opening 131 and the second opening 141, respectively. The first base board 310 of the upper cover 31 is disposed on the tongue portion 12 and the second base board 320 of the lower cover 32 is disposed under the tongue portion 12. The upper sheltering walls 312 and the lower sheltering walls 322 are end-to-end attracted with one another to enclose two opposite sides of the tongue portion 12. Rear ends of the upper sheltering walls 312 and the lower sheltering walls 322 abut against the front surface 101 of the base body 11. The first front wall 314 and the second front wall 324 abut against a front of the tongue portion 12, and are end-to-end attracted with each other to make the first groove 315 matched with the corresponding second groove 325 to together define a circular receiving groove 33 longitudinally aligned with the corresponding inserting hole 13. The touching portion 211 of the probe pin 20 projects forward out of the inserting hole 13 and further projects into the corresponding receiving groove 33 under the elasticity action of the elastic element 22. The upper cover 31 and the lower cover 32 are further firmly integrated with each other by means of the first fastening portion 111 and the second fastening portion 112 being respectively fastened in the first hole 313 and the second hole 323 with ultrasonic welding technology.

In use, the upper cover 31 and the lower cover 32 of the foolproof mechanism 30 can effectively guide the probe connector 100 to be mated with the mated connector based on the principle of homopolar repulsion and heteropolar attraction, wherein the mated connector has two portions thereof provided with different magnetism selected from a south magnetic pole and a north magnetic pole, respectively. So it can avoid a wrong connection between the probe connector 100 and the mated connector.

As described above, the second hole 323 is different from the first hole 313 in diameter so as to realize the difference between the upper cover 31 and the lower cover 32. Furthermore, in use, the upper cover 31 and the lower cover 32 of the foolproof mechanism 30 having different magnetism can effectively guide the probe connector 100 to be mated with the mated connector based on the principle of homopolar repulsion and heteropolar attraction, because of corresponding two portions of the mated connector being provided with different magnetism. So, it can avoid the wrong connection between the probe connector 100 and the mated connector, and a better electrical connection is assured.

What is claimed is:

1. A probe connector adapted for electrically interconnecting with a mated connector which has two portions thereof provided with different magnetism selected from a south magnetic pole and a north magnetic pole respectively, the probe connector comprising:

an insulating housing having a base body, a front surface of the base body protruding frontward to form a tongue portion, the insulating housing defining a plurality of inserting holes penetrating through the base body and the tongue portion along a front-to-rear direction;

a plurality of probe pins inserted forward in the corresponding inserting holes of the insulating housing, each of the probe pins having a touching portion capable of projecting forward out of the corresponding inserting hole; and a foolproof mechanism made of magnetic material and including an upper cover and a lower cover which have different magnetism selected from a north magnetic pole and a south magnetic pole respectively, the upper cover and the lower cover being mounted to two opposite sides of the tongue portion and further end-to-end attracted with each other to be integrated together and enclose the tongue portion therebetween, wherein the probe connector can be interconnected with the mated connector based on principles of homopolar repulsion and heteropolar attraction between the upper cover and the lower cover of the foolproof mechanism and the two portions of the mated connector.

2. The probe connector as claimed in claim 1, wherein the upper cover has a first base board of which two opposite ends are bent downward to form two upper sheltering walls and a front extends downward to form a first front wall, the lower cover has a second base board of which two opposite ends are bent upward to form two lower sheltering walls and a front extends upward to form a second front wall, the upper cover and the lower cover are integrated with each other by means of the upper sheltering walls and the lower sheltering walls end-to-end attracted with one another, and the first front wall and the second front wall end-to-end attracted with each other, a plurality of receiving grooves is opened in the front wall and longitudinally penetrates through the front wall to be aligned with the inserting holes of the insulating housing for receiving the touching portions of the probe pins therein, respectively.

3. The probe connector as claimed in claim 2, wherein a first opening and a second opening are opened in a top surface and a bottom surface of the base body of the insulating housing respectively and further penetrate through the front surface of the base body, a first fastening portion and a second fastening portion are oppositely protruded in substantial middles of the first opening and the second opening respectively, a rear of the first base board of the upper cover extends rearward to form a first fastening board with a first hole opened in a substantial middle thereof, a rear of the second base board of the lower cover extends rearward to form a second fastening board with a second hole opened in a substantial middle thereof, the fastening boards are inserted rearward in the openings, with the fastening portions being fastened in the holes, respectively.

4. The probe connector as claimed in claim 3, wherein the first fastening portion and the second fastening portion are respectively fastened in the first hole and the second hole by means of ultrasonic welding technology.

5. The probe connector as claimed in claim 3, wherein the first hole of the upper cover is different from the second hole of the lower cover in diameter so as to discriminate the upper cover from the lower cover.

* * * * *